US006252200B1

(12) United States Patent
Heinz et al.

(10) Patent No.: US 6,252,200 B1
(45) Date of Patent: Jun. 26, 2001

(54) PROCESS FOR SEALING THE TERMINAL-SIDE END AREA OF THE GLOW TUBE OF A GLOW PLUG AND GLOW PLUGS WITH A SEAL AS CLAIMED IN THE PROCESS

(75) Inventors: Rudi Heinz, Remsock; Rainer Hain, Steinheim, both of (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 09/540,898

(22) Filed: Mar. 31, 2000

(30) Foreign Application Priority Data

Mar. 31, 1999 (DE) ..... 199 14 619

(51) Int. Cl.[7] ..... F23Q 7/00

(52) U.S. Cl. ..... 219/270; 219/541; 219/544; 123/145 A; 338/322

(58) Field of Search ..... 219/270, 541, 219/544; 123/145 A, 145 R; 361/264–266; 338/322

(56) References Cited

U.S. PATENT DOCUMENTS

| | | | | |
|---|---|---|---|---|
| 4,211,204 | | 7/1980 | Glauner et al. . | |
| 4,221,452 | | 9/1980 | Remington . | |
| 4,312,120 | * | 1/1982 | Comer | 219/270 |
| 4,477,717 | * | 10/1984 | Walton | 219/270 |
| 4,733,053 | * | 3/1988 | Mueller | 219/270 |
| 5,589,091 | * | 12/1996 | Muller | 219/270 |
| 5,783,801 | * | 7/1998 | Riti et al. | 219/270 |

FOREIGN PATENT DOCUMENTS

| | | |
|---|---|---|
| 196 30 402 | 1/1998 | (DE) . |
| 40 997 | 12/1981 | (EP) . |
| 989 370 | 3/2000 | (EP) . |
| 10-185192 * | 7/1998 | (JP) . |

* cited by examiner

*Primary Examiner*—John A. Jeffery
(74) *Attorney, Agent, or Firm*—Nixon Peabody LLP; David S. Safran

(57) ABSTRACT

This invention relates to a process for sealing of the terminal-side end area of the glow tube of a glow plug, this area of the glow tube (3) being crimped.

7 Claims, 1 Drawing Sheet

PROCESS FOR SEALING THE TERMINAL-SIDE END AREA OF THE GLOW TUBE OF A GLOW PLUG AND GLOW PLUGS WITH A SEAL AS CLAIMED IN THE PROCESS

FIELD OF THE INVENTION

The subject matter of the invention is a process for sealing the terminal-side end area of the glow tube of a glow plug and a corresponding glow plug.

BACKGROUND OF THE INVENTION

Reducing the diameter of the terminal-side end area of the glow tube of a glow plug by rotary swaging is known, in which a central, solid and sealing connection of the end of the glow tube to the projecting inner pole of the glow plug will be achieved without damage of the gasket which is located in this area.

To do this, rotary swaging machines which are also called hammering or reducing machines are used which reduce the outside diameter in an advance process by forming under compressive a conditions with a relatively high speed working pulse sequence and thus close the glow tube filled with the inner pole and insulator via the gasket.

Rotary swaging machines use tools which radially oscillate via rams with high working frequency form the workpiece located in the center of the tools accordingly. In doing so then a high-speed, brief forming stroke of the tool is transmitted to the workpiece located in the center when a ram pair passes under the roller pair. Between the strokes the rams and tools are opened by centrifugal force and the workpiece continues to be inserted axially. The tolerances which can be achieved in rotary swaging in a cold working process are +/−0.01 mm.

The original outside diameter of the glow tube is reduced in a certain length to a certain amount which is conventionally not yet the final amount, and thus sits stationary on the inner pole, sealing element and insulating material. The connection which has been produced hereby must be of a bulk nature for the next working process which relates to reduction of the heating rod to its final size.

The high noise evolution which necessitates the noise control booths is disadvantageous in the rotary swaging process and rotary swaging devices known from the prior art. The noise evolution is caused by the necessary high ram frequency which is caused by the low forming per stroke of the rotary swaging machine. The friction portion of the workpieces in the tools must be great to prevent the workpiece from being expelled from the tools opposite the feed direction. The noise arises especially at the locations at which the rams hit the rollers, tools hit the workpiece, and in idle, the tool halves of the rotary swaging devices hit one another.

In addition, due to the large radial and axial loading of the end area to be machined in the glow tube there is the danger of damage of the sealing elements located in it, for example by overstretching.

SUMMARY OF THE INVENTION

As experience shows, a central location of the inner pole cannot be set 100% reliably so that in this way undesirable failures occurs. Since the glow tube turns concomitantly in the tool, there is the danger that it will be milled in adjacent areas. Disadvantageously high investment costs, large space requirement and disproportional tool wear are also added, therefore the process of rotary swaging known beforehand is overdimensioned as a means for sealing of the glow tube end area; likewise it has been shown that the indicated production tolerances are not necessary here.

The object of the invention is to make available a process, while surmounting the indicated defects, such that it is tailored to the requirements of sealing of the indicated glow tube end area and can be incorporated to mass production of glow plugs, and allows further processing in mass production. In particular damage to the gasket material will be avoided to prevent harmful penetration of oxygen. Finally, glow plugs will be made available in which the sealing of the terminal-side end area of a glow plug tube meets the necessary requirements for this sealing.

The object of the invention is achieved by the process as claimed in claim 1 with the advantageous embodiments as claimed in claims 2 to 5, and by the glow plug as claimed in claim 6 with the following preferred embodiments as claimed in claim 7.

BRIEF DESCRIPTION OF THE DRAWINGS

The invention is detailed using the attached FIGS. 1 and 2.

DETAILED DESCRIPTION OF THE INVENTION

Figure 1:
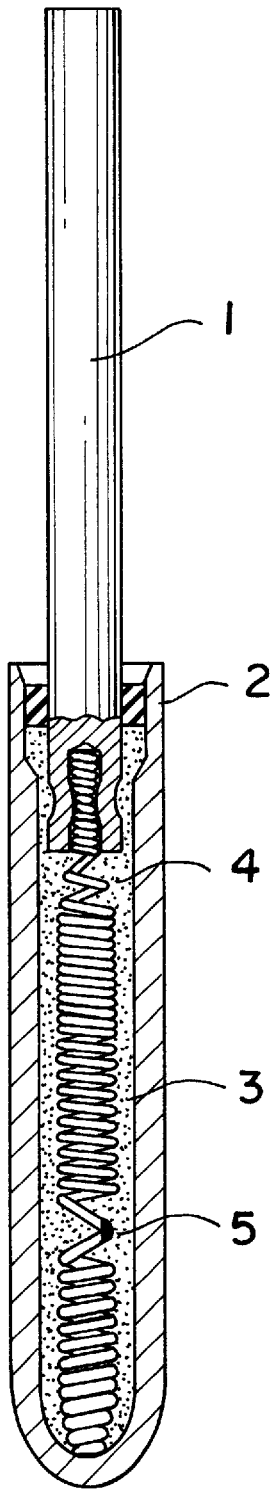
FIG. 1 is a lengthwise schematic section through a glow plug from the prior art.

As shown in FIG. 1 a glow plug conventionally consists of a glow tube 3 with heating elements and optionally control elements 5 which are embedded in insulating material 4. The heating element or elements 5 are permanently connected on the terminal side to a rod-shaped inner pole 1 within the glow tube 3; the inner pole 1 projects out of the terminal-side end area of the glow tube 3; it is conventionally fixed centered in the outlet opening by means of an overlying sealing element 2, the sealing element 2 simultaneously sealing the interior of the glow tube 3 to the outside. This terminal-side end area of the glow tube 3 is conventionally closed by rotary swaging for fixing and to secure the inner pole 1 and complete the sealing, the diameter of this glow tube area being reduced at the same time.

Figure 2:
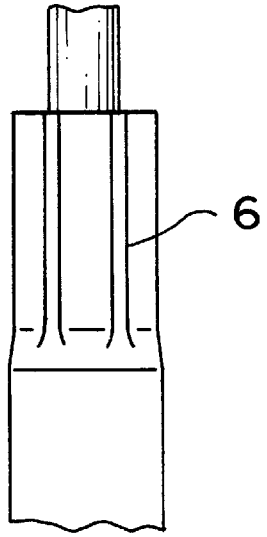
FIG. 2 is a schematic side view of the terminal-side end area of the glow tube of a glow plug which has been manufactured as claimed in the invention.

As shown in FIG. 2, the crimping as claimed in the invention with a conventional crimping tool leads to crimping 6 of the terminal-side end area of the glow tube 3, by which the inner pole 1 is fixed in the center and the sealing element 2, preferably a gasket, is not damaged because in contrast to the conventional rotary swaging, rolling, or roll flanging process, deformation of the gasket takes place far below the permanent elongation limit of conventional material. Preferably six crimp fins are made which are located uniformly around the indicated end area; the axial length of the crimping in this embodiment is preferably roughly 10 mm.

Then the entire heating rod is further compressed by swaging and in doing so the diameter is reduced to its final amount. In this process the crimping is reworked and again acquires a cylindrical shape and surface which is then pressed into the glow plug body.

The advantages of the invention can be summarized as follows:

Due to use of conventional crimping tools the process as claimed in the invention requires less investment costs and lower tool costs due to the simplified approach and the simplified device, at the same time higher service lives and higher cycle times can be achieved.

In addition, concentricity is more exact than in the prior art and damage to the gasket is avoided; at the same time in the process as claimed in the invention, much less noise evolution than known previously occurs.

The glow plugs as claimed in the invention in addition have less susceptibility to penetration of oxygen and the resulting failure.

What is claimed is:

1. A process for sealing a terminal-side end area of a glow tube of a glow plug, characterized in that the terminal-side end area of the glow tube (3) is crimped into a predetermined number of crimp fins.

2. The process of claim 1, wherein the terminal-side area of the glow tube (3) in which one or more heating elements and/or control elements (5) are embedded in the insulating material (4), is sealed with a sealing element (2), and crimping (6) is done via the sealing element (2).

3. The process of claim 1 or 2, wherein crimping is done with a simultaneous reduction of a diameter of the terminal-side end area of the glow tube (3).

4. The process of claim 3, wherein the diameter is reduced by roughly 8–10%.

5. The process of claim 1, wherein the crimp fin area is reworked into cylindrical shape.

6. A glow plug with a glow tube (3), in which in the insulating material (4) one or more heating elements and/or control elements (5) are embedded, the terminal-side end area of the heating element (5) being permanently connected to a rod-shaped inner pole (1), the inner pole (1) projecting out of the terminal-side end area of the glow tube (3), and this end area of the glow tube (3) being crimped into a predetermined number of crimp fins and then reworked into cylindrical shape via a sealing element (2) which surrounds the inner pole (1) and which seals the interior of the glow tube (3).

7. The glow plug of claim 6, wherein the crimping (6) has six crimp fins distributed uniformly around the end area of the glow tube (3), the glow tube diameter of this area being reduced by the crimping process by roughly 8 to 10%, and the crimping (6) running the axial direction over roughly 10 mm.

* * * * *